US008308461B2

(12) United States Patent
Kuwahara et al.

(10) Patent No.: US 8,308,461 B2
(45) Date of Patent: Nov. 13, 2012

(54) SCROLL COMPRESSOR WITH IMPROVED ROTATION PREVENTION MECHANISM

(75) Inventors: Takayuki Kuwahara, Aichi (JP); Tetsuzou Ukai, Aichi (JP); Katsuhiro Fujita, Aichi (JP); Takahide Ito, Aichi (JP); Makoto Takeuchi, Aichi (JP); Norio Hioki, Aichi (JP); Hideshi Hamamura, Aichi (JP); Koji Terasaki, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 882 days.

(21) Appl. No.: 12/441,796

(22) PCT Filed: Nov. 14, 2008

(86) PCT No.: PCT/JP2008/070814

§ 371 (c)(1), (2), (4) Date: Mar. 18, 2009

(87) PCT Pub. No.: WO2009/084338

PCT Pub. Date: Jul. 9, 2009

(65) Prior Publication Data

US 2010/0172781 A1 Jul. 8, 2010

(30) Foreign Application Priority Data

Dec. 27, 2007 (JP) ..... 2007-337114

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |
| ***F04C 18/02*** | (2006.01) |
| ***F04C 18/063*** | (2006.01) |

(52) U.S. Cl. ..... 418/55.3; 418/55.1

(58) Field of Classification Search ..... 418/55.1, 418/55.3

See application file for complete search history.

(56) References Cited

U.S. PATENT DOCUMENTS 5,542,829 A * 8/1996 Inagaki et al. ..... 418/55.3

(Continued)

FOREIGN PATENT DOCUMENTS

JP 01178784 A * 7/1989

(Continued)

OTHER PUBLICATIONS

International Search Report of PCT/JP2008/070814, date of mailing Jan. 13, 2009.

(Continued)

*Primary Examiner* — Mary A Davis

(74) *Attorney, Agent, or Firm* — Westerman, Hattori, Daniels & Adrian, LLP

(57) ABSTRACT

To provide a scroll compressor capable of reducing a noise occurring in a pin-and-ring type self rotation preventing mechanism and improving compression performance. In a scroll compressor comprising: a fixed scroll member and a revolving scroll member; a driven crank mechanism for driving the revolving scroll member to revolutionary turn; and a pin-and-ring type self rotation preventing mechanism provided in plural places for preventing self rotation of a revolving scroll member, at least one of the self rotation preventing pin, the self rotation preventing ring and the self rotation preventing ring hole, which form the pin-and-ring type self rotation preventing mechanism, is provided with an orbit correction part for reducing a maximum displacement R in a direction of self rotation of the revolving scroll member to smooth a change of an orbit of the revolving scroll member in changing a pin and a ring in a section of prevention of self rotation by means of a corresponding pin and ring part.

7 Claims, 7 Drawing Sheets

U.S. PATENT DOCUMENTS

| | | | | | |
|---|---|---|---|---|---|
| 5,795,141 | A | * | 8/1998 | Oki et al. | 418/55.3 |
| 5,807,089 | A | * | 9/1998 | Tsumagari et al. | 418/55.3 |
| 2007/0253853 | A1 | | 11/2007 | Takeuchi et al. | |

FOREIGN PATENT DOCUMENTS

| | | | | |
|---|---|---|---|---|
| JP | 02308991 | A | * | 12/1990 |
| JP | 03210001 | A | * | 9/1991 |
| JP | 6-317265 | A | | 11/1994 |
| JP | 9-042172 | A | | 2/1997 |
| JP | 11-13657 | A | | 1/1999 |
| JP | 2000-170671 | A | | 6/2000 |
| JP | 2001-090678 | A | | 4/2001 |
| JP | 2007-224923 | A | | 9/2007 |
| JP | 2007-297950 | A | | 11/2007 |
| JP | 2008-267149 | A | | 11/2008 |
| WO | 2008-102864 | A1 | | 8/2008 |

OTHER PUBLICATIONS

Japanese Office Action dated Mar. 6, 2012, issued in corresponding Japanese Patent Application No. 2007-337114.

* cited by examiner

SCROLL COMPRESSOR WITH IMPROVED ROTATION PREVENTION MECHANISM

TECHNICAL FIELD

The invention relates to a scroll compressor comprising a driven crank mechanism for making a revolving radius of a revolving scroll member variable and a pin-and-ring type self rotation preventing mechanism for preventing self rotation of the revolving scroll member.

BACKGROUND ART

In a scroll compressor comprising a pair of a fixed scroll member and a revolving scroll member, which are engaged with each other to form a compression chamber, even in the case that the fixed scroll member and the revolving scroll member have a fine process error or an assembly error, conventionally used has been a driven crank mechanism for certainly making laps contact with each other to minimize a leakage of compression gas so as to secure compression efficiency in accordance with the error. The driven crank mechanism is arranged to be able to make a revolving radius of the revolving scroll member variable. The driven crank mechanism uses centrifugal force, compression reaction force of a gas or the like to drive the revolving scroll member to perform revolutionary turning so that a lap of the revolving scroll member would be pushed against a lap of the fixed scroll member.

Further, in order to prevent self rotation of the revolving scroll member in driving the revolving scroll member to perform revolutionary turning around the fixed scroll member as described above, provided is a self rotation preventing mechanism between the revolving scroll member and a support member of the revolving scroll member or between the revolving scroll member and the fixed scroll member. As a typical example of the self rotation preventing mechanism, named can be an Oldham ring mechanism, a pin-and-ring mechanism and such. Moreover, Patent Citation 1 discloses a scroll compressor comprising a drive mechanism of the revolving scroll member used as the driven crank mechanism, the scroll compressor wherein a pin-and-ring type self rotation preventing mechanism is used as the self rotation preventing mechanism.

On the other hand, put to practical use has been a pin-and-ring type self rotation preventing mechanism in a scroll compressor using the driven crank mechanism and the pin-and-ring type self rotation preventing mechanism in combination, the pin-and-ring type self rotation preventing mechanism wherein two of pins and rings provided in plural places simultaneously become into contact to prevent an operation of the driven crank mechanism from being limited, a maximum displacement in a direction of self rotation of the revolving scroll member (a center distance between a center of the ring hole of the revolving scroll member and a center of the self rotation preventing pin) R, the maximum displacement being determined on the basis of engagement of a ring hole of the revolving scroll member, a self rotation preventing ring fitted to the ring hole and a self rotation preventing pin, is set at a large value with respect to a theoretical revolving radius of the revolving scroll member so as to include a revolving radius variable by means of the driven crank mechanism for the purpose of preventing an excessive load from operating on one of the self rotation preventing pins located in two places, the one located in a self rotation moment direction, and a location for providing the self rotation preventing pin is offset in accordance with the setting to provide pins and rings for preventing self rotation of the revolving scroll member in plural places (Patent Citation 2).

Patent Citation 1: Japanese Unexamined Patent Application, Publication No. Hei-11-13657

Patent Citation 2: Japanese Unexamined Patent Application, Publication No. 2007-297950

DISCLOSURE OF INVENTION

In the pin-and-ring type self rotation preventing mechanism in which the maximum displacement in a direction of self rotation of the revolving scroll member (the center distance between a center of the ring hole of the revolving scroll member and a center of the self rotation preventing pin) R is set at a large value and a location for providing the self rotation preventing pin is offset, as described above, however, occurs a shock sound when self rotation preventing performance borne by one pair of pin and ring among pins and rings, which are provided in plural places, is transferred to another pair of pin and ring (in a change of a pin and a ring) in accordance with rotation of the compressor. In the case that the ring holes and the self rotation preventing rings are provided in four places on a revolving scroll member side, the self rotation preventing pins are provided in four places on a support member side so as to correspond to the above, and the both are fitted to each other, for example, an orbit of the center of the ring hole of the revolving scroll member does not form a complete circle due to an influence such that the maximum displacement R is set at a large value and a location for providing the self rotation preventing pin is offset in accordance with the setting. The orbit of the center of the ring hole changes in a change of the self rotation preventing pin. A change in speed caused by the change in orbit (an orbit bending angle $\xi$) gives the self rotation preventing pin a shock load. This can be considered to be a cause of a noise (a shock sound) occurring in the pin-and-ring type self rotation preventing mechanism.

In view of such circumstances, an object of the invention is to provide a scroll compressor capable of reducing a noise occurring in a pin-and-ring type self rotation preventing mechanism as well as improving compression performance.

In order to solve the problem, the scroll compressor in accordance with the invention uses the following solutions.

That is to say, a scroll compressor in accordance with a first aspect of the invention is a scroll compressor comprising: a pair of a fixed scroll member and a revolving scroll member, the pair being engaged with each other to form a compression chamber; a driven crank mechanism for driving the revolving scroll member to revolutionary turn around the fixed scroll member; and a pin-and-ring type self rotation preventing mechanism for preventing self rotation of a revolving scroll member by setting a maximum displacement R in a direction of self rotation of the revolving scroll member, the maximum displacement R being determined in accordance with contact among plural pairs of a self rotation preventing pin and a self rotation preventing ring, plural pairs of the self rotation preventing pin and a self rotation preventing ring hole or plural pairs of self rotation preventing pin, the self rotation preventing ring and the self rotation preventing ring hole, at a large value with respect to a theoretical revolving radius of the revolving scroll member so as to include a revolving radius variable by means of the driven crank mechanism and by offsetting the self rotation preventing pin, the self rotation preventing ring or the self rotation preventing ring hole in a direction of reducing a twist of the revolving scroll member to the fixed scroll member in accordance with the maximum displacement R, the scroll compressor characterized in that at least one of the self rotation preventing pin, the self rotation preventing ring and the self rotation preventing ring hole is provided with an orbit correction part for reducing the maximum displacement R to smooth a change of an orbit of the revolving scroll member in changing a pin and a ring in a section of prevention of self rotation by means of a corresponding pin and ring part.

In accordance with the first aspect of the invention, an orbit correction part for reducing the maximum displacement (a center distance between a center of a ring hole of the revolving scroll member and a center of the self rotation preventing pin) R in a direction of self rotation of the revolving scroll member to smooth a change of an orbit of the revolving scroll member in changing a pin and a ring in a section of prevention of self rotation by means of a corresponding pin and ring part is provided in plural pairs of pin and ring parts. This allows the change of the orbit (the orbit bending angle $\xi$) of the revolving scroll member in changing the pin and the ring, which contribute to prevention of self rotation of the revolving scroll member, to be smoothed, and a shock load given to the pin and ring part by a change in speed due to the above to be reduced. Accordingly, the noise (the shock sound) occurring in the pin-and-ring type self rotation preventing mechanism can be suppressed. Further, an amount of self rotation (a twist amount) of the revolving scroll member can be reduced by reducing the maximum displacement R in the section of prevention of self rotation by means of each pin and ring part. This allows a leakage of gas due to a twist of the revolving scroll member to be reduced and a performance in compression to be improved.

In the scroll compressor in accordance with the invention, it may be possible to arrange that the self rotation preventing pin be provided in a thrust support member of the revolving scroll member, the self rotation preventing ring hole be provided in the revolving scroll member and the self rotation preventing ring be provided in the self rotation ring hole, respectively.

In accordance with such a structure, the self rotation preventing pin is provided in a thrust support member (the front housing) of the revolving scroll member, the self rotation preventing ring hole is provided in the revolving scroll member and the self rotation preventing ring is provided in the self rotation ring hole, respectively. Accordingly, the pin-and-ring type self rotation preventing mechanism formed from plural pairs of the self rotation preventing pins, the self rotation preventing rings and the self rotation preventing ring holes can be compactly and collectively provided between the thrust support member of the revolving scroll member and a back surface of the revolving scroll member. This allows the pin-and-ring type self rotation preventing mechanism to be housed excellently, and thereby, the scroll compressor to be miniaturized and reduced in weight.

In the scroll compressor in accordance with the invention, it may be possible to arrange that the orbit correction part be provided in the self rotation preventing ring hole of the revolving scroll member.

In accordance with such a structure, the orbit correction part is provided in the self rotation preventing ring hole of the revolving scroll member. Accordingly, the orbit correction part can be easily put into practice only by a simple modification of a structure such that only the shape of the self rotation preventing ring hole of the revolving scroll member is partially modified. This allows the noise reduction effect and the performance improvement effect to be achieved without any increase in number of components and in cost.

In the scroll compressor in accordance with the invention, it may be possible to arrange that the orbit correction part be formed into the shape of a ring hole formed by smoothly connecting the self rotation preventing ring hole having a small arc for reducing the maximum displacement R in a section of prevention of self rotation by means of the pin and ring part to the self rotation preventing ring hole having a large arc for increasing the maximum displacement R in a section of no prevention of self rotation by means of the pin and ring part.

In accordance with such a structure, the orbit correction part is formed into the shape of a ring hole formed by smoothly connecting the self rotation preventing ring hole having a small arc for reducing the maximum displacement R to the self rotation preventing ring hole having a large arc for increasing the maximum displacement R. Accordingly, only changing a process for the self rotation preventing ring hole allows the orbit correction part to be provided in the self rotation preventing ring hole. Therefore, a slight modification of a structure can easily put the invention into practice.

In the scroll compressor in accordance with the invention, it may be possible to arrange the orbit correction part be formed into the shape of a ring hole formed by extending a small arc for reducing the maximum displacement R at least to a theoretical point of a change of the pin and the ring to connect the small arc to the self rotation preventing ring hole having a large arc for increasing the maximum displacement R.

In accordance with such a structure, the orbit correction part is formed by forming a self rotation preventing ring hole of the revolving scroll member into the shape obtained by extending a small arc for reducing the maximum displacement R at least to a theoretical point (in a geometrical shape) of a change of the pin and the ring to connect the small arc to the self rotation preventing ring hole having a large arc for increasing the maximum displacement R. Accordingly, the orbit correction part can be provided in the self rotation preventing ring hole of the revolving scroll member only by changing a process for the self rotation preventing ring hole. This allows the invention to be easily put into practice by a slight modification of a structure. The small arc may be extended a little beyond the theoretical point (in a geometric shape) at which the pin and the ring are changed in order to absorb tolerances of a location for providing the self rotation preventing pin and such.

In any one of the above-mentioned scroll compressors in accordance with the invention, it may be possible to arrange that the orbit correction part be formed so that a ring thickness recognized as a difference between an outer diameter and an inner diameter of the self rotation preventing ring would be increased in the section of prevention of self rotation.

In accordance with such a structure, the orbit correction part is formed so that a ring thickness recognized as a difference between an outer diameter and an inner diameter of the self rotation preventing ring would be increased in the section of prevention of self rotation. Accordingly, the orbit correction part can be formed by arranging the outer diameter of the self rotation preventing ring to be used as it is while arranging the ring thickness to be adjusted (increased) on an inner diameter side to reduce the maximum displacement R. This requires no modification of the self rotation preventing ring hole of the revolving scroll member where the self rotation preventing ring is provided. That is to say, a degree of freedom in design can be improved for an object of achieving the effect (any of modification of the shape of the ring hole or the thickness of the ring can be selective in consideration of a performance in process, assembly and cost).

In the scroll compressor in accordance with the invention, it may be possible to arrange that the orbit correction part be formed into a ring shape formed by smoothly connecting a small arc for reducing the maximum displacement R of the self rotation preventing ring to a large arc for increasing the maximum displacement R.

In accordance with such a structure, the orbit correction part is formed by forming the self rotation preventing ring of the revolving scroll member into a ring shape obtained by connecting a small arc for reducing the maximum displacement R to a large arc for increasing the maximum displacement R. Accordingly, the orbit correction part can be provided in the self rotation preventing ring only by modification of process on the inner diameter side of the self rotation preventing ring. This allows the invention to be easily put into practice by only a slight modification of a structure.

In any one of the above-mentioned scroll compressors in accordance with the invention, it may be possible to arrange that the orbit correction part be provided in a pin outer circumference of the self rotation preventing pin.

In accordance with such a structure, the orbit correction part is provided in a pin outer circumference of the self rotation preventing pin. Accordingly, the invention can be put into practice by a simple modification of a structure such that the shape of the outer circumference of the self rotation preventing pin is partially changed. This allows effects of noise reduction and improvement in performance to be achieved without any increase in number of components and in cost. Furthermore, improved can be a degree of freedom in design while the object of achieving the effects can be accomplished (any of modification of the shape of the ring hole, the thickness of the ring or the shape of the outer circumference of the pin can be selective in consideration of a performance in process, assembly or cost).

In the scroll compressor in accordance with the invention, it may be possible to arrange that the orbit correction part be formed so that the pin outer circumference of the self rotation preventing pin would be formed into the shape of a pin outer circumference formed by smoothly connecting a large arc for reducing the maximum displacement R to a small arc for increasing the maximum displacement R.

In accordance with such a structure, the orbit correction part is formed so that the pin outer circumference of the self rotation preventing pin would be formed into the shape of a pin outer circumference formed by smoothly connecting a large arc for reducing the maximum displacement R to a small arc for increasing the maximum displacement R. This allows the orbit correction part to be formed in the self rotation preventing pin only by modifying a process for the outer circumference of the pin. Accordingly, a slight modification in structure allows the invention to be easily put into practice.

In any one of the above-mentioned scroll compressors in accordance with the invention, it may be possible to arrange that the orbit correction part be provided to set an orbit bending angle $\xi$ of the revolving scroll member in changing the pin and the ring at $\xi \leqq 0.9$ deg.

In accordance with such a structure, the orbit correction part is provided to set an orbit bending angle $\xi$ of the revolving scroll member in changing the pin and the ring at $\xi \leqq 0.9$ deg. Accordingly, achieved can be a noise reduction effect of around $\Delta 3$ dB(A) or more at an acoustic power level in the case that the number of rotation of the compressor is 2600 rpm or more. This is a difference of noise, which is a sound that most of people can generally tell by hearing. This means that the noise reduction effect can be definitely confirmed in the case of application to an air conditioning compressor for a vehicle whose running sound has been made silent in recent years, for example.

In any one of the above-mentioned scroll compressors in accordance with the invention, it may be possible to arrange that the self rotation preventing ring hole, the self rotation preventing ring and the self rotation preventing pin be provided in four to six or more plural places.

In accordance with such a structure, the self rotation preventing ring hole, the self rotation preventing ring and the self rotation preventing pin are provided in four to six or more plural places. Accordingly, the orbit bending angle $\xi$ of the revolving scroll member in changing the pin and ring part can be reduced as much as possible to smooth a change of the orbit of the revolving scroll member in accordance with the reduction. This allows the shock load given to the pin and ring part to be further reduced and the noise reduction effect to be further increased.

A scroll compressor in accordance with Second Embodiment of the invention is a scroll compressor comprising: a pair of a fixed scroll member and a revolving scroll member, the pair being engaged with each other to form a compression chamber; a driven crank mechanism for driving the revolving scroll member to revolutionary turn around the fixed scroll member; and a pin-and-ring type self rotation preventing mechanism for preventing self rotation of the revolving scroll member by setting a maximum displacement R in a direction of self rotation of the revolving scroll member, the maximum displacement R being determined in accordance with contact among plural pairs of a self rotation preventing pin and a self rotation preventing ring, plural pairs of the self rotation preventing pin and a self rotation preventing ring hole or plural pairs of self rotation preventing pin, the self rotation preventing ring and the self rotation preventing ring hole, at a large value with respect to a theoretical revolving radius of the revolving scroll member so as to include a revolving radius variable by means of the driven crank mechanism and by offsetting the self rotation preventing pin, the self rotation preventing ring or the self rotation preventing ring hole in a direction of reducing a twist of the revolving scroll member to the fixed scroll member in accordance with the maximum displacement R, the scroll compressor characterized in that the self rotation preventing ring is provided through an elastic ring member fitted in an outer circumference of the self rotation preventing ring.

In accordance with Second Embodiment of the invention, the self rotation preventing ring of the pin-and-ring type self rotation preventing mechanism is provided through an elastic ring member fitted in an outer circumference of the self rotation preventing ring. Accordingly, the elastic ring member can absorb and ease the shock load operating on the pin and ring part by changing the orbit of the revolving scroll member at a point where the pin and ring part contributing to prevention of self rotation of the revolving scroll member is changed. This allows the noise (the shock sound) occurring in the pin-and-ring type self rotation preventing mechanism to be reduced.

In accordance with the invention, a change of the orbit of the center of the ring hole (the orbit bending angle $\xi$) in a change of the self rotation preventing pin can be smoothed and a shock load given to the pin and ring part in accordance with a change in speed due to the above to be reduced. This allows the noise (the shock sound) occurring in the pin-and-ring type self rotation preventing mechanism to be suppressed. Moreover, a decrease of the maximum displacement R in a direction of self rotation of the revolving scroll member can reduce an amount of self rotation (a twist amount) of the revolving scroll member. This allows a leakage of gas due to a twist of the revolving scroll member to be reduced and a performance in compression to be improved.

Further, in accordance with the invention, the elastic ring member can absorb and ease the shock load operating on the pin and ring part in accordance with a change of the orbit of the center of the ring hole at a point where the pin and the ring, which contribute to prevention of self rotation of the revolving scroll member, are changed. This allows the noise (the shock sound) occurring in the pin-and-ring type self rotation preventing mechanism to be reduced.

EXPLANATION OF REFERENCE

1: SCROLL COMPRESSOR
25: FIXED SCROLL MEMBER
27: REVOLVING SCROLL MEMBER
27D: RING HOLE
33: PIN-AND-RING TYPE SELF ROTATION PREVENTING MECHANISM
55: DRIVEN CRANK MECHANISM
63: SELF ROTATION PREVENTING PIN
65: SELF ROTATION PREVENTING RING
65A: INNER DIAMETER OF SELF ROTATION PREVENTING RING
67: ORBIT CORRECTION PART (RING HOLE)
67A: SMALL ARC (RING HOLE)
67B: LARGE ARC (RING HOLE)
67C, 67D: CONNECTION PART (RING HOLE)
77: ORBIT CORRECTION PART (SELF ROTATION PREVENTING PIN)
77A: LARGE ARC (SELF ROTATION PREVENTING PIN)
77B: SMALL ARC (SELF ROTATION PREVENTING PIN)
77C: CONNECTION PART (SELF ROTATION PREVENTING PIN)
87: ELASTIC RING MEMBER
97: ORBIT CORRECTION PART (SELF ROTATION PREVENTING RING)
97A: SMALL ARC (SELF ROTATION PREVENTING RING)
97B: LARGE ARC (SELF ROTATION PREVENTING RING)
97C: CONNECTION PART (SELF ROTATION PREVENTING RING)
R: MAXIMUM DISPLACEMENT (CENTER DISTANCE BETWEEN RING HOLE CENTER Oh AND SELF ROTATION PREVENTING PIN CENTER Op)
S: PIN AND RING CHANGING POINT
Δ Pin: OFFSET AMOUNT
ξ: ORBIT BENDING ANGLE
Z: ORBIT OF CENTER OF RING HOLE

BEST MODE FOR CARRYING OUT THE INVENTION

Now, described will be embodiments in accordance with the invention, made reference to the drawings.

First Embodiment

Now, described will be First Embodiment of the invention with reference to FIGS. 1 to 8.

Figure 1:
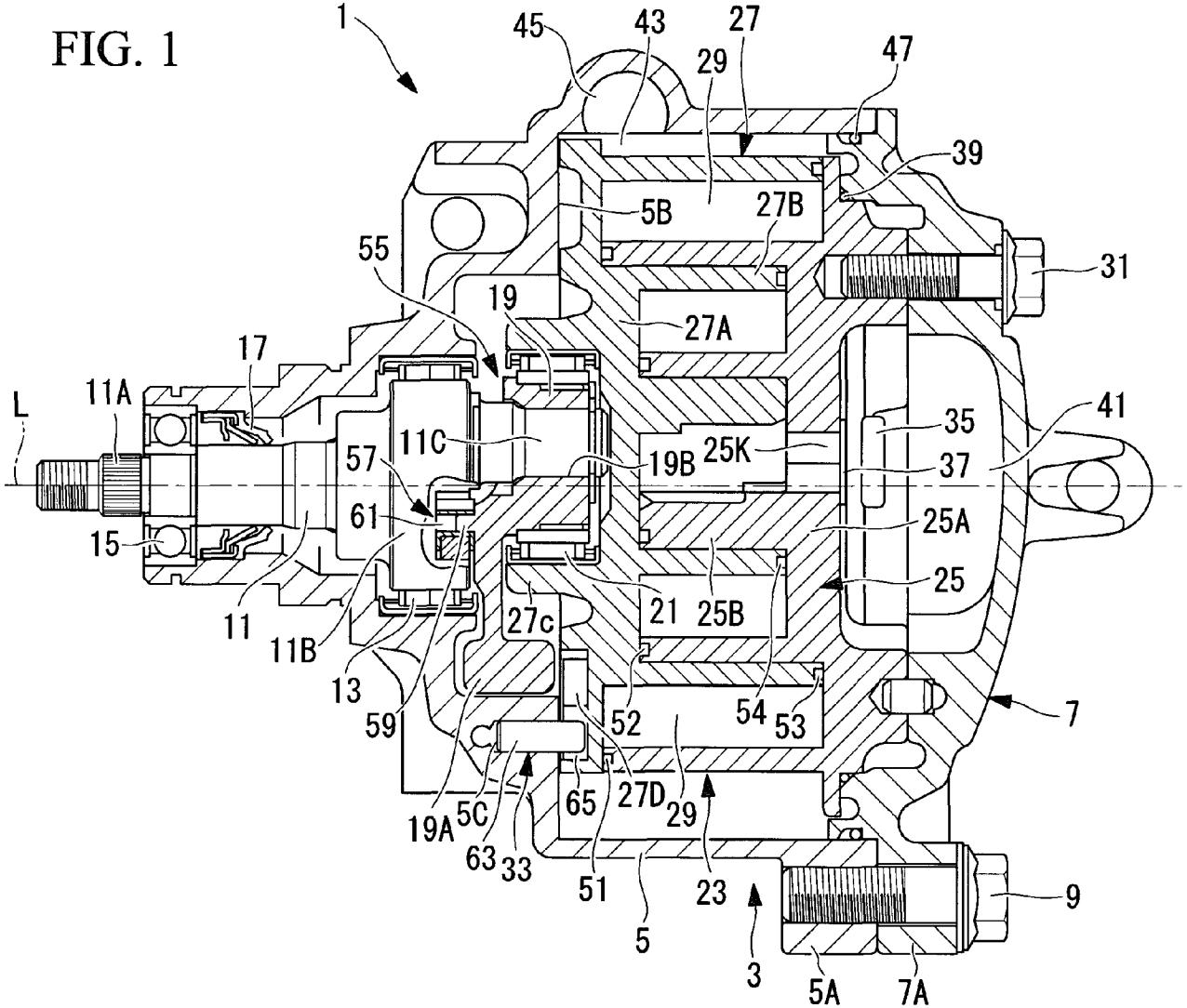
FIG. 1 It is a vertically sectional view of a scroll compressor in accordance with First Embodiment of the invention.
Figure 2:
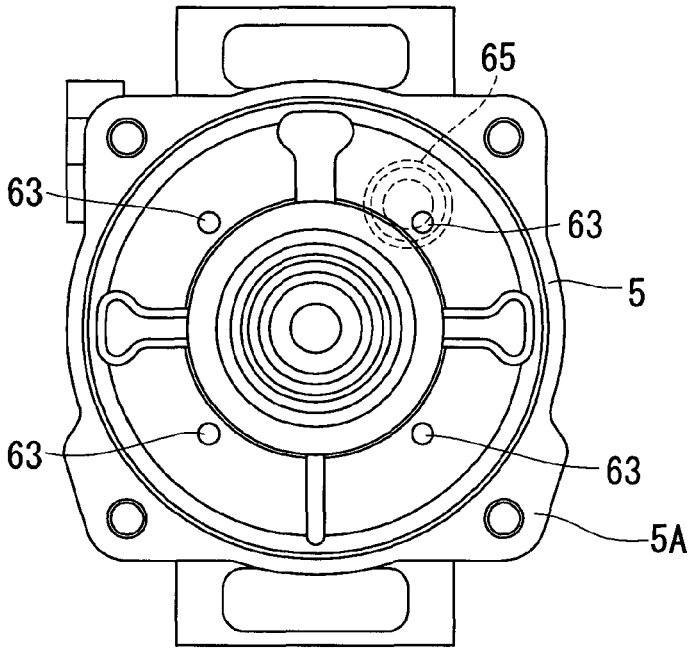
FIG. 2 It is a plan view of a front housing of the scroll compressor shown in FIG. 1, viewed from a right side of FIG. 1

FIG. 1 is a vertically sectional view of a scroll compressor 1 in accordance with First Embodiment of the invention. The scroll compressor 1 includes a housing 3 forming a substantially outer shape of the scroll compressor 1. The housing 3 is formed from a front housing 5 and a rear housing 7, which are fastened by means of a bolt 9 into one body. In respective circumferentially plural places, four places, for example, of the front housing 5 and the rear housing 7, formed into one body at even intervals are flanges 5A and 7A for fastening. Fastening the flanges 5A and 7A by means of the bolt 9 allows the front housing 5 and the rear housing 7 to be united into one body.

In the front housing 5, a crank shaft (a drive shaft) 11 is supported around an axial L through main bearings 13 and sub bearings 15 so as to be freely rotatable. One end of the crank shaft 11 (on the left side in FIG. 1) is a small diameter shaft part 11A. The small diameter shaft part 11A passes through the front housing 5 to project leftward in FIG. 1. To a projecting part of the small diameter shaft part 11A, mounted are an electromagnetic clutch, a pulley and such, which receive power and which are omitted from showing, as well known. The power is arranged to be transmitted from a drive source such as an engine omitted from showing through a V belt or the like. A mechanical seal (a lip seal) 17 is provided between the main bearings 13 and the sub bearings 15 to air-tightly put the seal between the housing 3 and the air.

On the other end of the crank shaft 11 (on the right side in FIG. 1), provided is a large diameter shaft part 11B. A crank pin 11C is provided integrally with the large diameter shaft part 11B so as to be eccentric to the axial L of the crank shaft 11 by a predetermined dimension. The crank shaft 11 is supported on the front housing 5 so as to be freely rotatable by supporting the large diameter shaft part 11B and the small diameter shaft part 11A on the main bearings 13 and the bearings 15. The crank pin 11C is connected to a later-mentioned revolving scroll member 27 through an eccentric bush 19 and drive bearings 21. Rotation of the crank shaft 11 causes the revolving scroll member 27 to be driven to turn.

A balance weight 19A for removing an unbalanced load caused by driving the revolving scroll member 27 to turn is formed integrally with the eccentric bush 19. The balance weight 19A is arranged to turn in accordance with a drive of turning of the revolving scroll member 27.

In the housing 3, assembled is a pair of a fixed scroll member 25 and the revolving scroll member 27, which form a scroll compression mechanism 23. The fixed scroll member 25 is formed from an end plate 25A and a spiral lap 25B erected from the end plate 25A. On the other hand, the revolving scroll member 27 is formed from an end plate 27A and a spiral lap 27B erected from the end plate 27A.

The fixed scroll member 25 and the revolving scroll member 27 in accordance with First Embodiment are respectively provided with a step at a predetermined position on a top end surface and a bottom surface of the spiral laps 25B and 27B along a spiral direction. On the respective sides of the step, the top end surface of the lap on an outer circumferential side in a direction of the axis L is high while the top end surface on an inner circumferential side is low. On the other hand, the bottom surface on an outer circumferential side in a direction of the axis L is low while the bottom surface on an inner circumferential side is high. This causes the height of the lap on the outer circumferential side of the spiral laps 25B and 27B to be higher than the height of the lap on the inner circumferential side.

The fixed scroll member 25 and the revolving scroll member 27 are engaged with the respective centers being separated by an amount of the revolving radius and with phases of the spiral laps 25B and 27B being different by 180 degrees. The fixed scroll member 25 and the revolving scroll member 27 are assembled so as to have a little gap (from several tens to several hundreds micrometers) in a direction of the height of the lap at a normal temperature between the top end surface and the bottom surface of the spiral laps 25B and 27B, respectively. This allows a pair of compression chambers 29 defined by the end plates 25A and 27A and the spiral laps 25B and 27B to be formed symmetrical with respect to the center of the scroll between the both scroll members 25 and 27, as shown in FIG. 1, and allows the revolving scroll member 27 to smoothly turn around the fixed scroll member 25.

The height of the compression chamber 29 in the direction of the axis L is arranged to be higher on the outer circumferential side of the spiral laps 25B and 27B than the height of the inner circumferential side. This contributes to form the scroll compression mechanism 23 capable of three-dimensional compression in which compression is possible in a circumferential direction of the spiral laps 25B and 27B and in a direction of the height of the laps. In the top end surfaces of the spiral laps 25B and 27B of the fixed scroll member 25 and the revolving scroll member 27, provided are chip seal members 51, 52, 53 and 54 for sealing a chip seal surface formed between the top end surface of one scroll member and the bottom surface of the other scroll member so that the chip seal members would be fitted into grooves provided in the top end surfaces.

The fixed scroll member 25 is fixed to an inner surface of the rear housing 7 by means of a bolt 31. On the other hand, the revolving scroll member 27 is arranged to be driven to turn by connecting the crank pin 11C provided on one end of the crank shaft 11 to a boss part 27C provided on a back of the end plate 27A through the eccentric bush 19 and the drive bearings 21, as described above. Further, the revolving scroll member 27 is arranged so that a back surface of the end plate 27A would be supported on a thrust receiving surface 5B formed in the front housing 5 and a later-mentioned pin-and-ring type self rotation preventing mechanism 33 provided between the thrust receiving surface 5B and the back surface of the end plate 27A would prevent self rotation and would drive the fixed scroll member 25 to perform revolutionary turning.

At a center part of the end plate 25A of the fixed scroll member 25, opened is a discharge port 25K for discharging compressed refrigerant gas. The discharge port 25K is provided with a discharge lead valve 37, which is mounted to the end plate 25A through a retainer 35. On the back surface of the end plate 25A of the fixed scroll member 25, provided is a seal member 39 such as an O-ring so as to be in close contact with an inner surface of the rear housing 7. The seal member 39 forms a discharge chamber 41 divided from an inner space of the housing 3 between the seal member 39 and the rear housing 7. This allows the inner space of the housing 3 other than the discharge chamber 41 to function as an intake chamber 43.

The refrigerant gas having returned from a refrigeration cycle via an intake port 45 provided in the front housing 5 is inhaled into the intake chamber 43 through which the refrigerant gas is inhaled into the compression chamber 29. On a connection surface between the front housing 5 and the rear housing 7, provided is a seal member 47 such as an O-ring. The seal member 47 air-tightly seals the intake chamber 43 formed in the housing 3 from the air.

The scroll compressor 1 is provided with a swing link type driven crank mechanism 55 between the crank shaft 11 and the eccentric bush 19 fitted in the boss 27C of the revolving scroll member 27. A structure of the driven crank mechanism 55 will be described hereinafter.

A crank pin 11C is provided integrally with the large diameter shaft part 11B of the crank shaft 11 at a position eccentric to the center of the crank shaft 11 by a predetermined dimension. The eccentric bush 19 fitted in the crank pin 11C is provided with an eccentric hole 19B at a position eccentric to the center of the bush by a predetermined dimension. The eccentric bush 19 is arranged to be rotatable (swingable) around the crank pin 11C by fitting the crank pin 11C in the eccentric hole 19B.

On the other hand, the revolving scroll member 27 is fitted in the eccentric bush 19 through the drive bearings 21 so as to be freely rotatable and so that the center of the end plate 27A would be accorded with the center of the bush. The distance between the center of the bush and the center of the crank shaft is arranged to be a revolving radius of the revolving scroll member 27. In accordance with such a structure, the eccentric bush 19 swings around the crank pin 11C, and thereby, the distance between the center of the bush and the center of the crank shaft is changed. This allows the revolving radius of the revolving scroll member 27 to be variable. Between the balance weight 19A formed into one body with the eccentric bush 19 and the large diameter shaft part 11B of the crank shaft 11, provided is a restriction mechanism 57 for restricting a range of a swing of the eccentric bush 19.

The restriction mechanism 57 comprises a restriction protrusion 59 provided on a balance weight 19A side and a restriction hole 61 provided on a large diameter part 11B side, the large diameter part 11B into which the restriction protrusion 59 is fitted with play. The restriction protrusion 59 and the restriction hole 61 are provided at a position offset from the center of the eccentric hole 19B and the center of the crank pin 11C. The restriction protrusion 59 and the restriction hole 61 are formed by forging or casting into one body with the balance weight 19A, which is formed into one body with the eccentric bush 19, and the crank shaft 11, respectively. The predetermined shape of the component is achieved by cutting a required part. The driven crank mechanism 55 having such a structure has been known conventionally.

Moreover, the pin-and-ring type self rotation preventing mechanism 33 for preventing self rotation of the revolving scroll member 27 is arranged as follows in First Embodiment.

Figure 3:
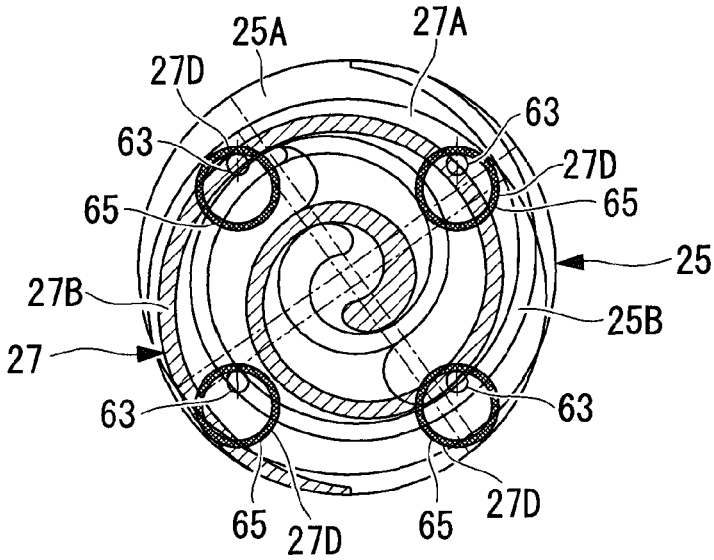
FIG. 3 It is a plan view of a pin-and-ring type self rotation preventing mechanism of the scroll compressor shown in FIG. 1, showing arrangement thereof.
Figure 4:
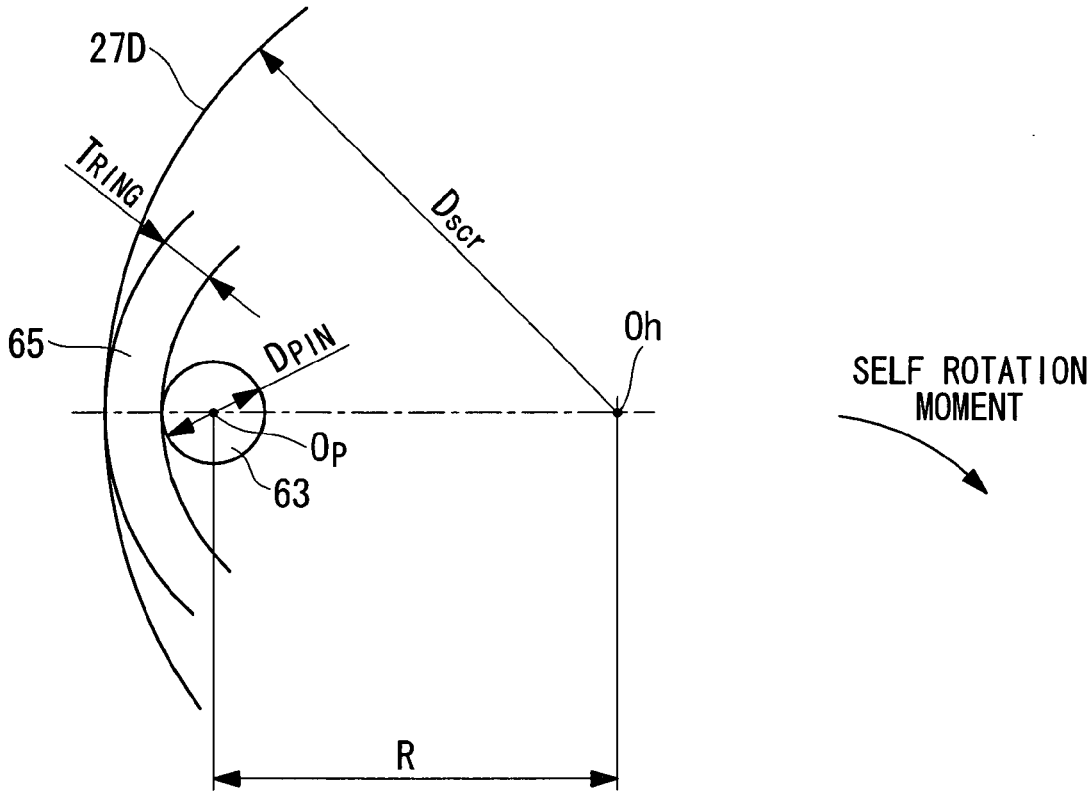
FIG. 4 It is a partially enlarged plan view of one pin-and-ring part of the pin-and-ring type self rotation preventing mechanism of the scroll compressor shown in FIG. 1.
Figure 5:
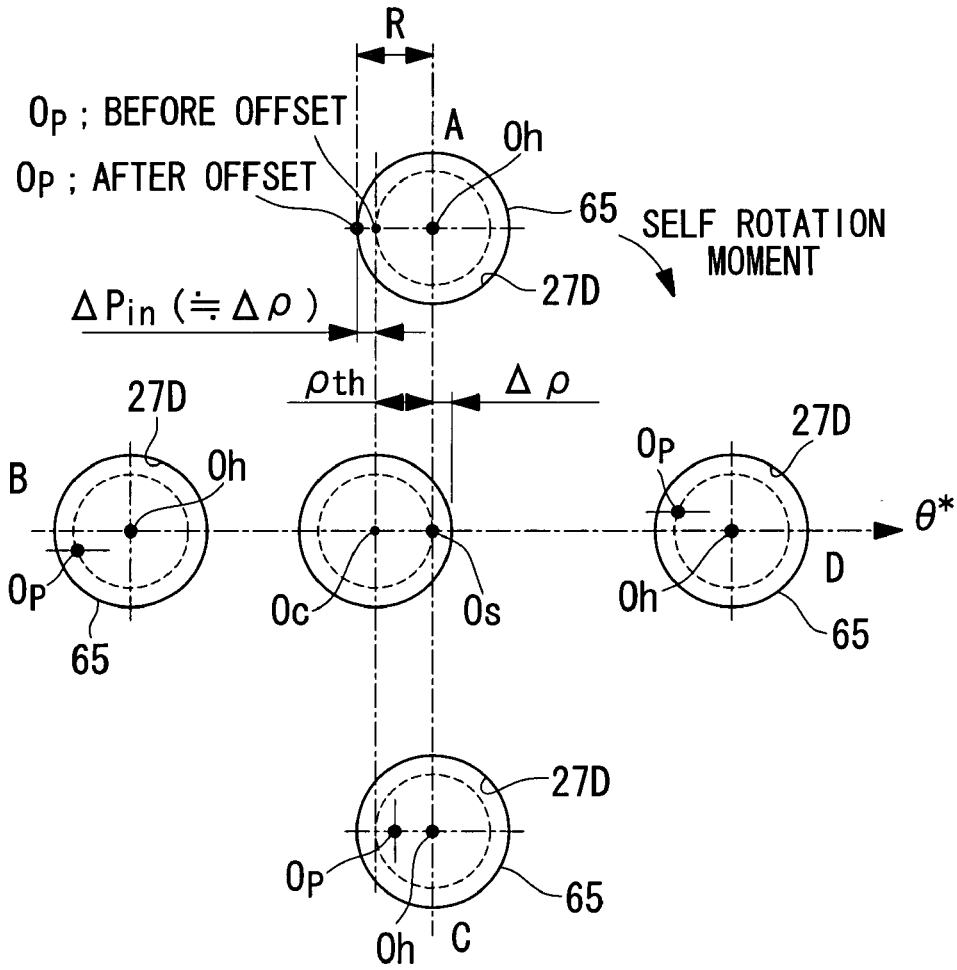
FIG. 5 It is a simplified view for illustrating a self rotation preventing operation of the pin-and-ring type self rotation preventing mechanism of the scroll compressor shown in FIG. 1.

The pin-and-ring type self rotation preventing mechanism 33 is formed from a self rotation preventing pin 63 fitted in a pin hole 5C provided in the front housing 5 and a self rotation preventing ring 65 fitted into a ring hole 27D provided in the revolving scroll member 27, the self rotation preventing pin 63 being fitted into the self rotation preventing ring 65. The self rotation preventing pin 63 is provided in four places (A to D) on a front housing 5 side, as shown in FIGS. 2 to 5. The self rotation preventing ring 65 is provided in four places (A to D) of the ring holes 27D on a revolving scroll member 27 side, as shown in FIGS. 3 to 5. A mark Os denotes the center of the end plate 27A of the revolving scroll member 27 in FIG. 5.

As shown in FIGS. 4 and 5, in the pin-and-ring type self rotation preventing mechanism 33, the ring holes 27D, the self rotation preventing rings 65 and the self rotation preventing pins 63, which are located in two places of a self rotation moment support position (A) and a position in a direction θ* (D), simultaneously become into contact to prevent an operation of the driven crank mechanism 55 from being restricted. Further, the maximum displacement in the self rotation direction of the revolving scroll member 27 (a center distance between a center Oh of the ring hole 27D and a center Op of the self rotation preventing pin 63) R, the maximum displacement R being determined in accordance with a contact of the ring hole 27D, the self rotation preventing ring 65 and the self rotation preventing pin 63, is set at a large value (an enlarged amount ΔR) with respect to a theoretical revolving radius ρth of the revolving scroll member 27 at the self rotation moment support position (A) for the purpose of preventing an excessive load from operating on one of the self rotation preventing pins 63 in the two places, the one being located at a position in the direction θ* (D), (preventing an excessive load from operating due to the short distance from the center of the end plate 27A). At the same time, in order to adjust a posture (a twist) of the revolving scroll member 27 in accordance with the above, moved counterclockwise in the drawings (an offset amount ΔPin) is a position where the self rotation preventing pin 63 is provided.

The maximum displacement (the center distance between the center Oh of the ring hole 27D and the center Op of the self rotation preventing pin 63) R can be made small by reducing the ring hole diameter Dscr, made small by increasing the plate thickness Tring, and further, made small by increasing the pin diameter Dpin, as shown in FIG. 4, wherein Dscr denotes the diameter of the ring hole 27D, Tring denotes the thickness of the ring plate of the self rotation preventing ring 65 and Dpin denotes the diameter of the self rotation preventing pin 63.

Figure 6:
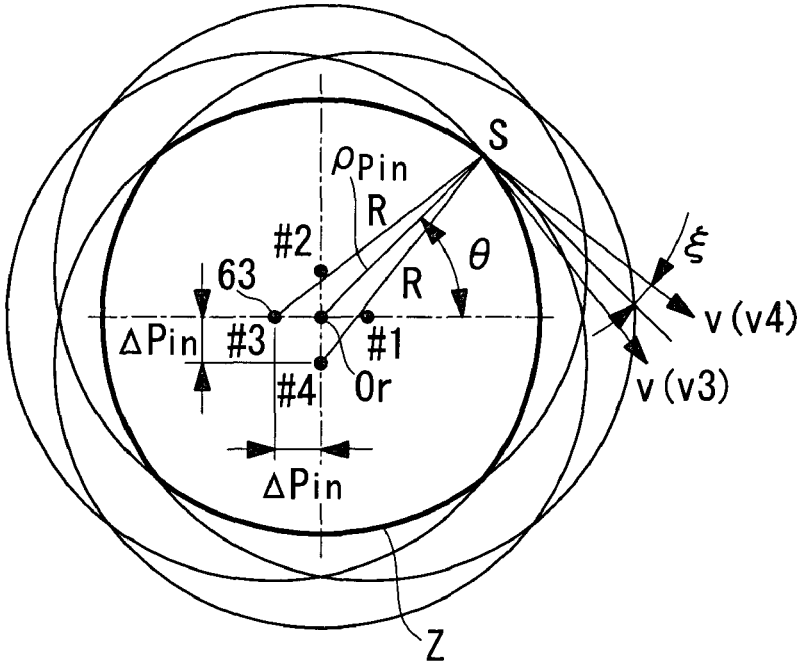
FIG. 6 It illustrates an orbit of a center of a ring hole of a self rotation preventing ring forming the pin-and-ring type self rotation preventing mechanism of the scroll compressor shown in FIG. 1.

The maximum displacement (the center distance between the center Oh of the ring hole 27D and the center Op of the self rotation preventing pin 63) R should be increased with respect to the theoretical revolving radius ρth of the revolving scroll member 27 by a lap tooth surface position displacement amount Δρ (a variable amount Δρ of a revolving radius of the driven crank mechanism 55≈the offset amount ΔPin≈ΔR) caused by a location for providing the self rotation preventing pin 63 and integration of tolerances of other components in order to achieve the offset function of the pin and the ring (a function for preventing restriction of an operation of the driven crank mechanism 55 and preventing an operation of an excessive load of the self rotation preventing pin). As a result, a center orbit Z of the ring hole 27D of the revolving scroll member 27 cannot form a complete circle but form an orbit having a change in orbit at a point S (θ=45 deg) where the pin and the ring are changed and where the self rotation moment is supported, as shown in FIG. 6.

The larger an angle ξ is, the larger the change in orbit is, wherein an orbit bending angle ξ of the ring hole center Oh is an angle at the pin and ring changing point S between a tangent of a circle whose center is a geometrical center Or (equal to the center Oc of the crank shaft 11) of revolving drive of the center Oh of the ring hole 27D, the circle having a radius ρpin, and a tangent of a circle about the self rotation preventing pin 63 (#3 and 4) (equal to a part of the orbit of the center of the ring hole 27D), the circle having a radius R. A change in speed in accordance with the change in orbit operates on the pin and ring part as a large shock load, which causes occurrence of a noise (a shock sound).

Figure 7:
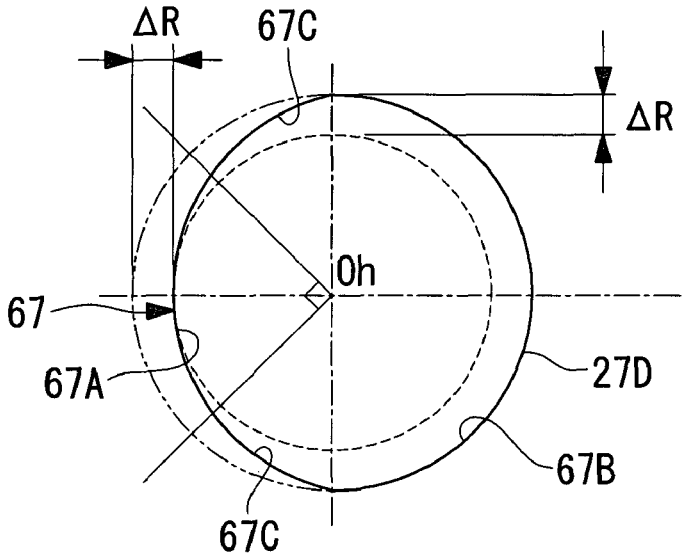
FIG. 7 It is a plan view of a self rotation preventing ring hole forming the pin-and-ring type self rotation preventing mechanism of the scroll compressor shown in FIG. 1, showing the shape of the hole.

Accordingly, an orbit correction part 67 is provided in the ring hole 27D of the revolving scroll member 27, as shown in FIG. 7, for the purpose of smoothing the change in orbit and reducing the orbit bending angle ξ in First Embodiment. The orbit correction part 67 is formed into the shape of a ring hole, which is formed by connecting the small ark 67A to the ring hole 27D of a large arc 67B larger than the small arc 67A by ΔR via a smooth connection part 67C in an $n^{th}$-degree function. In the small arc 67A, the center distance R between the center Op of the self rotation preventing pin 63 and the center Oh of the ring hole 27D, the center distance R being determined in accordance with a contact among the ring hole 27D of each pin and ring part, the self rotation preventing ring 65 and the self rotation preventing pin 63, is made substantially equal to a revolving circle of the revolving scroll member 27 before offset in a section where the ring holes 27D, the self rotation preventing ring 65 and the self rotation preventing pin 63, which are provided in four places, respectively support the self rotation moment to contribute to prevention of the self rotation of the revolving scroll member 27.

In accordance with the above-described structure, First Embodiment has the following advantage in operation.

The rotation drive power is transmitted to the crank shaft 11 from an external drive source through a pulley, an electromagnetic clutch and such, which are not shown. When the crank shaft 11 is rotated, the revolving scroll member 27 connected to the eccentric pin 11C of the crank shaft 11 through the driven crank mechanism 55 formed from the drive bush 19 and such so that the revolving radius of the revolving scroll member 27 would be variable is prevented by the pin-and-ring type self rotation preventing mechanism 33 from carrying out self rotation and is driven to perform revolutionary turning around the fixed scroll member 25.

The drive for revolutionary turning of the revolving scroll member 27 causes the refrigerant gas in the intake chamber 43 to be inhaled in the compression chamber 29 formed on the most external side in the radius direction. The compression chamber 29 is closed to stop the inhalation at a predetermined revolving angle position and moved to the center side with the capacity thereof being reduced in a circumferential direction and a lap height direction. The refrigerant gas is compressed during the above. The discharge lead valve 37 is opened to discharge the compressed gas having high temperature and high pressure into the discharge chamber 41 when the compression chamber 29 reaches a position communicating to the discharge port 25K. The discharged gas is sent to the outside of the compressor 1 through the discharge chamber 41.

During the above, the ring holes 27D, the self rotation preventing pins 63 and the self rotation preventing rings 65, which are provided in four places in the pin-and-ring type self rotation preventing mechanism 33, support the self rotation moment of the revolving scroll member 27 by orderly contact of the self rotation preventing pins 63 with inner circumferential surfaces of the ring holes 27D of the self rotation preventing rings 65 in sections of prevention of self rotation, which are provided at every 90 deg, the prevention of self rotation being achieved by the respective ring holes 27D, the self rotation preventing pins 63 and the self preventing rings 65. This causes the revolving scroll member 27 to be prevented from performing self rotation, and thereby, the revolving scroll member 27 is driven to carry out revolutionary turning.

Figure 8:
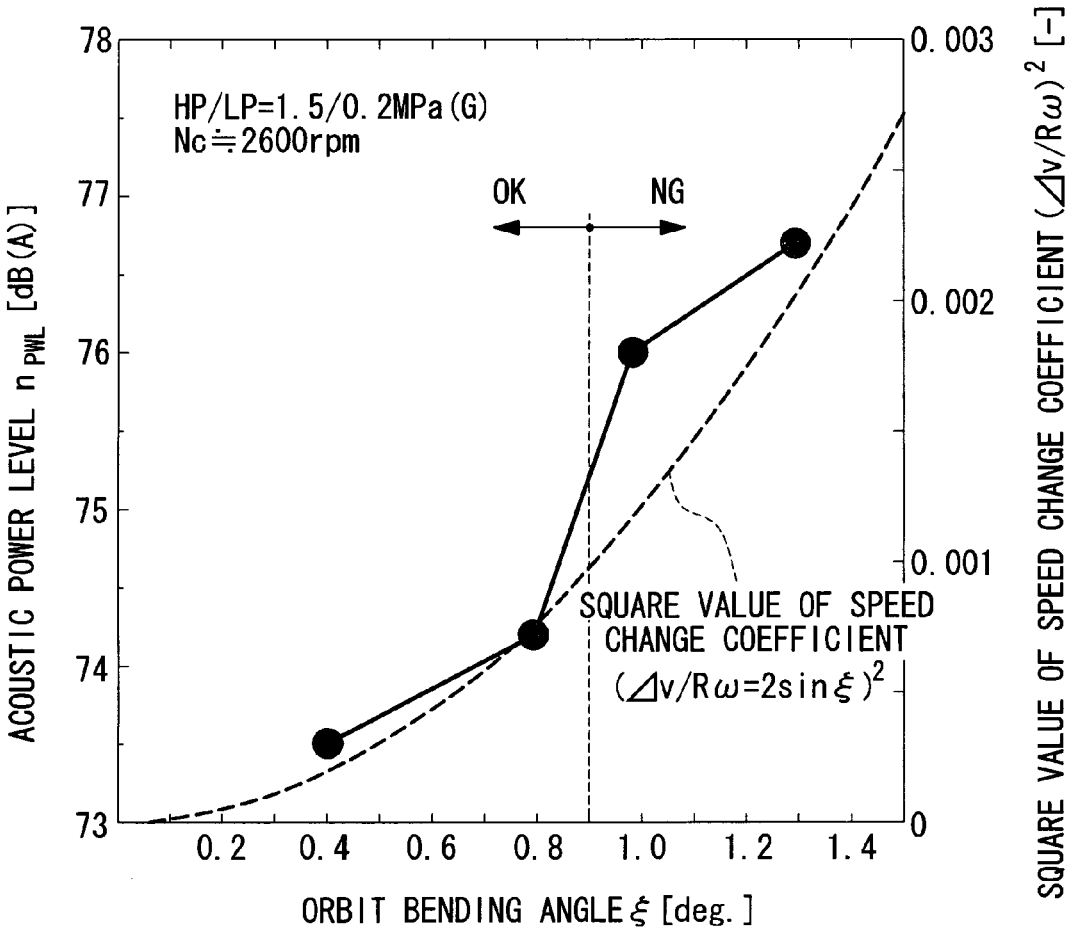
FIG. 8 It is a graph showing a result of noise measurement of the pin-and-ring type self rotation preventing mechanism of the scroll compressor shown in FIG. 1.

In each ring hole 27D of the revolving scroll member 27 forming the pin-and-ring type self rotation preventing mechanism 33, provided is the orbit correction part 67 for achieving the offset function as well as reducing the center distance R between the self rotation preventing pin 63 and the ring hole 27D, the center distance R being determined in accordance with each pin and ring part, and for smoothing a change in orbit of the ring hole center Oh in changing the pin and the ring. Accordingly, a change in orbit of the ring hole center Oh (the orbit bending angle ξ) can be smoothed at the point of changing the pin and the ring S and a shock load given to the pin and ring part by a change in speed due to the above can be reduced. FIG. 8 shows a result of noise measurement with the orbit bending angle ξ used as a parameter under a condition of HP/LP=1.5/0.2 MPa(G) and Nc=2600 rpm. The right axis in FIG. 8 shows a square value of a speed change coefficient as a representative value of shock energy in changing the pin and the ring, the square value expressed by the following formula (1):

$$\Delta v/R*\omega=2*\sin\xi \quad (1)$$

wherein Δv denotes a change in speed of the center Oh of the ring hole at the point S of changing the pin and the ring while R denotes a distance between the center Op of the self rotation preventing pin 63 and the center Oh of the ring hole 27D (the point S) (refer to FIG. 6). Further, in the formula (1), it can be seen that the change in speed Δv of the ring hole center Oh is proportional to the angle speed ω, that is, the number of rotation of the compressor in the case that the orbit bending angle is fixed.

As clearly shown in FIG. 8, an acoustic power level is reduced in accordance with a decrease of the square value of the speed change coefficient due to reduction of the orbit bending angle ξ of the ring hole center Oh in changing the pin and the ring. In the case that the orbit bending angle ξ is under the condition of ξ≦0.9 deg, achieved could be a noise reduction effect of about Δ3 dB(A). This is a difference of noise, which is a sound that most of people can generally tell by hearing. This means that the noise reduction effect can be definitely confirmed in the case of application to an air conditioning compressor for a vehicle whose running sound has been made silent in recent years, for example. The noise reduction effect increases in proportion to the number of rotation of the compressor, as expressed by the formula (1) (the noise reduction effect of about Δ4 dB(A) was achieved under the condition of Nc≈4400 rpm).

In accordance with First Embodiment, providing the orbit correction part 67 in the ring hole 27D of the revolving scroll member 27 forming the pin-and-ring type self rotation preventing mechanism 33 allows the offset function to be achieved as well as the change in orbit of the ring hole center Oh in changing the pin and the ring, which contribute to prevention of self rotation of the revolving scroll member 27, (the orbit bending angle of the center Oh of the ring hole 27D) to be smoothed and the shock load given to the pin and ring part by the change in speed in accordance with the above to be reduced. Accordingly, the noise (the shock sound) occurring in the pin-and-ring type self rotation preventing mechanism 33 can be suppressed.

At the same time, a self rotation amount (a twist amount) of the revolving scroll member 27 can be reduced since the distance R between the centers of the self rotation preventing pin 63 and the ring hole 27D of the revolving scroll member 27 is made small. This allows a leakage of the gas due to a twist of the revolving scroll member 27 to be reduced, so that the compression performance can be improved.

Moreover, the orbit correction part 67 is arranged to form the shape formed by connecting the small ark 67A in which the center distance R is made small with respect to the ring hole 27D of the revolving scroll member 27 to the ring hole 27D of the large arc 67B having the large center distance R through the smooth connection part 67C in an $n^{th}$-degree function. Accordingly, the invention can be easily put into practice only by a slight modification of the structure such as a change of a conventional way of processing the ring hole 27D to partially modify the shape of the ring hole 27D. This allows the noise reduction and improvement in performance of the scroll compressor 1 using the pin-and-ring type self rotation preventing mechanism 33 to be achieved without increasing the number of components and increasing in cost.

Especially, as a result of an experiment under the condition of Nc≈2600 rpm, confirmed could be a fact that the noise reduction effect of about Δ3 dB(A) in the acoustic power level could be achieved in the case of providing the orbit correction part 67 to set the orbit bending angle ξ of the ring hole center Oh in changing the pin and the ring at ξ≦0.9 deg. This is a difference of noise, which is a sound that most of people can generally tell by hearing. This means that the noise reduction effect can be definitely confirmed in the case that the invention is applied to an air conditioning compressor for a vehicle whose running sound has been made silent in recent years.

Furthermore, the ring holes 27D of the revolving scroll member 27, the self rotation preventing rings 65 and the self rotation preventing pins 63, which form the pin-and-ring type self rotation preventing mechanism 33, are provided in four places in First Embodiment. It may be possible, however, to provide the ring holes 27D of the revolving scroll member 27, the self rotation preventing rings 65 and the self rotation preventing pins 63 in 4 to 6 or more places in order to decrease the orbit bending angle of the ring hole center Oh as much as possible. Providing the ring holes 27D of the revolving scroll member 27, the self rotation preventing rings 65 and the self rotation preventing pins 63 in 4 to 6 or more plural places as described above allows the orbit bending angle to be made small as much as possible, and thereby, a change of the orbit of the ring hole center Oh to be smoothed more. Accordingly, a shock load giving to the pin and ring part can be further reduced to increase the noise reduction effect.

Second Embodiment

Figure 9:
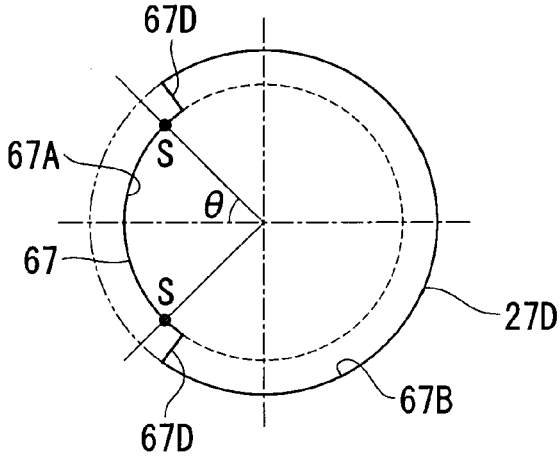
FIG. 9 It is a plan view of a self rotation preventing ring hole forming a pin-and-ring type self rotation preventing mechanism of a scroll compressor in accordance with Second Embodiment of the invention, showing the shape of the hole.

Now, described will be Second Embodiment of the invention, made reference to FIG. 9.

Second Embodiment is different from First Embodiment in a part of the shape of the orbit correction part 67 provided in the ring hole 27D of the revolving scroll member 27. Other points are same as First Embodiment, and therefore, omitted from description.

In Second Embodiment, the orbit correction part 67 is arranged to form the shape of a ring hole formed by extending the small arc 67A having the small center distance R at least to the point S (θ=45 deg) at which the pin and the ring is changed, further extending the extended arc a little for the purpose of absorbing tolerances of a location for providing the self rotation preventing pin 63 and such, and then, connecting the extended arc to the ring hole 27D of the large arc 67B having the large center distance R through a connection part 67D.

Forming the ring hole 27D of the revolving scroll member 27 into the above shape also allows the center distance R to be made small in sections where the pins and the rings, which are provided in plural places, respectively contribute to prevention of self rotation, and thereby, a change of the orbit of the ring hole center Oh in changing the pin and the ring to be smoothed. This causes the change of the orbit of the ring hole center Oh in changing the pin and the ring, which contribute to prevention of the self rotation of the revolving scroll member 27, (the orbit bending angle ξ of the ring hole center Oh) to be reduced and allows a shock load given to the pin and ring part by a change in speed due to the above to be reduced. Accordingly, an advantage similar to that of First Embodiment can be achieved.

Additionally, the orbit correction part 67 can be provided in the ring hole 27D of the revolving scroll member 27 only by changing a process for the ring hole 27D. This allows the invention to be easily put into practice with a slight modification of a structure. Further, the small arc 67A is arranged to extend a little beyond the point S ((θ=45 deg) at which the pin and the ring are changed for the purpose of absorbing tolerances of a location for providing the self rotation preventing pin 63 and such. Accordingly, the noise reduction effect can be certainly achieved regardless of existence of the tolerances.

Third Embodiment

Figure 10:
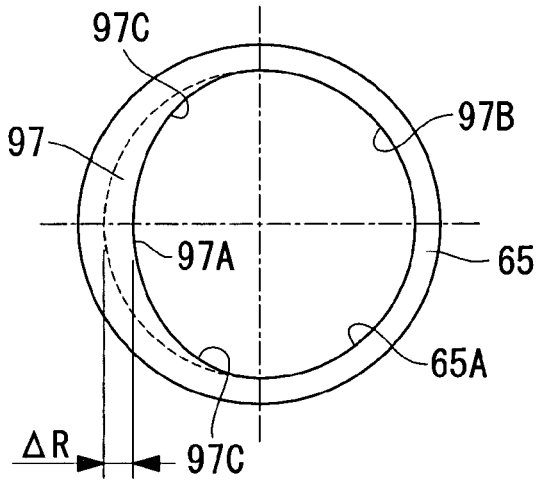
FIG. 10 It is a plan view of a self rotation preventing ring forming a pin-and-ring type self rotation preventing mechanism of a scroll compressor in accordance with Third Embodiment of the invention, showing the shape of the ring.

Now, described will be Third Embodiment of the invention, made reference to FIG. 10.

Third Embodiment is different from First Embodiment in a structure of the self rotation preventing ring 65. Other points are same as First Embodiment, and therefore, omitted from description.

In Third Embodiment, an orbit correction part 97 is provided in the self rotation preventing ring 65 so that the ring hole 27D provided in the revolving scroll member 27 would be formed into the shape of a complete circle, an outer circumference of the self rotation preventing ring 65 fitted to the ring hole 27D would be formed into the shape of a complete circle and the ring thickness, which is a difference between an outer diameter and an inner diameter, would be increased by ΔR in a section of prevention of self rotation. The shape of an inner circumference of the self rotation preventing ring 65 in Third Embodiment is similar to the shape of the ring hole 27D described in First Embodiment. The shape of the inner circumference is an inner circumferential shape 65A in which a small arc 97A is connected to a large arc 97B through a connection part 97C.

Using the self rotation preventing ring 65 having such a structure can also achieve an advantage similar to that of First Embodiment. In accordance with the self rotation preventing ring 65, it is possible to form the orbit correction part 97 by increasing the thickness of the ring to reduce the offset amount on an inner diameter side with the outer circumference being kept to be a complete circle. This allows the ring hole 27D for mounting the self rotation preventing ring 65 to be used as it is without any change, so that modification of a structure can be only for the self rotation preventing ring 65 and suppressed to a minimum.

Fourth Embodiment

Figure 11:
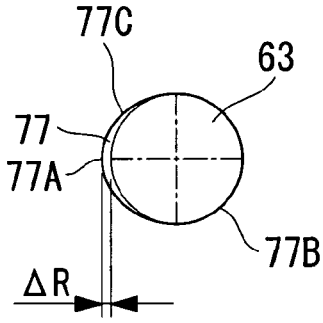
FIG. 11 It is a plan view of a self rotation preventing pin forming a pin-and-ring type self rotation preventing mechanism of a scroll compressor in accordance with Fourth Embodiment of the invention, showing the shape of the pin.

Now, described will be Fourth Embodiment of the invention, made reference to FIG. 11.

Fourth Embodiment is different from First Embodiment in that an orbit correction part 77 is provided in the self rotation preventing pin 63. Other points are same as First Embodiment, and therefore, omitted from description.

In Fourth Embodiment, the orbit correction part 77 is provided in the self rotation preventing pin 63 so that the center distance R between the self rotation preventing pin 63 and the ring hole 27D would be reduced to smooth a change of the orbit of the ring hole center Oh at the pin and ring changing point S for the purpose of making the orbit bending angle ξ small in a section where prevention of self rotation is achieved by means of each of the ring holes 27D, the self rotation preventing rings 65 and the self rotation preventing pins 63, as shown in FIG. 11.

The orbit correction part 77 is arranged to be formed into a pin outer circumferential shape, which is formed by providing a large arc 77A having the outer diameter larger by ΔR than that of each self rotation preventing pin 63 and by connecting the large arc 77A to the self rotation preventing pin 63 having the outer circumference of a small arc 77B causing the large center distance R through the smooth connection part 77C in a section where the ring holes 27D, the self rotation preventing rings 65 and the self rotation preventing pins 63 provided in four places respectively support self rotation moment to prevent self rotation of the revolving scroll member 27.

An advantage in operation almost equal to First Embodiment can be also achieved by providing the orbit correction part 77 on a self rotation preventing pin 63 side, the orbit correction part 77 in which the center distance R between the self rotation preventing pin 63 and the ring hole 27D is made small and a change of the orbit of the ring hole center Oh in changing the pin and the ring is smoothed to reduce the orbit bending angle ξ.

Further, in accordance with Fourth Embodiment, the orbit correction part 77 can be easily put into practice only by a simple modification in structure such that only the pin outer circumferential shape of the self rotation preventing pin 63 is partially modified. This allows the noise reduction effect and the performance improvement effect to be achieved without any increase in number of components and in cost.

Fifth Embodiment

Figure 12:
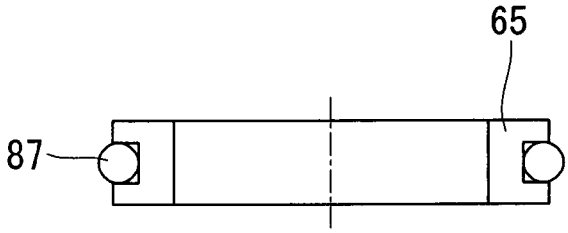
FIG. 12 It is a plan view of a self rotation preventing ring forming a pin-and-ring type self rotation preventing mechanism of a scroll compressor in accordance with Fifth Embodiment of the invention.

Now, described will be Fifth Embodiment of the invention, made reference to FIG. 12.

Fifth Embodiment is different from First Embodiment in a structure of the self rotation preventing ring 65. Other points are same as First Embodiment, and therefore, omitted from description.

In Fifth Embodiment, an elastic ring member 87 such as an O-ring is fitted in an outer circumference of the self rotation preventing ring 65 to provide the self rotation preventing ring 65 in the ring groove 27D through the elastic ring member 87, as shown in FIG. 12, instead of providing an orbit correction part in the self rotation preventing ring 65 or the self rotation preventing pin 63.

The self rotation preventing ring 65 of the pin-and-ring type self rotation preventing mechanism 33 is provided through the elastic ring member 87 fitted in the outer circumference of the self rotation preventing ring 65, as described above. This allows the shock load operating on the pin and ring part to be absorbed and eased by means of the elastic ring member 87 by changing the orbit of the ring hole center Oh of the revolving scroll member 27 in changing the pin and the ring, which contribute to prevention of the self oration of the revolving scroll member 27. Accordingly, the noise (the shock sound) occurring in the pin-and-ring type self rotation preventing mechanism 33 can be reduced.

The invention is not limited to the invention in accordance with the above embodiments. The invention may be properly modified within a range not deviated from the spirit thereof. In the above embodiments, exemplified is an open type scroll compressor 1, for example. The invention, however, can be applied to a closed type scroll compressor with a motor built in, of course. Moreover, exemplified in the above embodiments is a case that the self rotation preventing ring 65 is provided on a revolving scroll member 27 side while the self rotation preventing pin 63 is provided on a front housing 5 side. On the contrary, however, it may be possible to provide the self rotation preventing ring 65 on the front housing 5 side and provide the self rotation preventing pin 63 on the revolving scroll member 27 side. Further, the pin-and-ring type self rotation preventing mechanism 33 may be provided between the fixed scroll member 25 and the revolving scroll member 27.

As for the self rotation preventing ring 65, described was a structure that the ring hole 27D is provided in the end plate 27A of the revolving scroll member 27 so as to fit the self rotation preventing ring 65 into the ring hole 27D. It may be possible, however, to form the ring hole 27D per se as a self rotation preventing ring inner circumference 65A (refer to FIG. 10) to use the self rotation preventing ring inner circumference 65A as the self rotation preventing ring 65 so as to omit the self rotation preventing ring provided separately, in accordance with a component such as the revolving scroll member 27 and the front housing 5 on a side where the self rotation preventing ring 65 is provided. The invention includes such a structure. Similarly, the self rotation preventing pin 63 may be also formed into one body with the revolving scroll member 27, the front housing 5 and such. Furthermore, the driven crank mechanism 55 is not limited to the swing link type but may be a slide type driven crank mechanism.

The invention claimed is:

1. A scroll compressor comprising:

a pair of a fixed scroll member and a revolving scroll member, the pair being engaged with each other to form a compression chamber; a driven crank mechanism for driving the revolving scroll member to revolutionary turn around the fixed scroll member; and a pin-and-ring self rotation preventing mechanism for preventing self rotation of the revolving scroll member by setting a maximum displacement R in a direction of self rotation of the revolving scroll member, the maximum displacement R being determined in accordance with contact among plural pairs of a self rotation preventing pin and a self rotation preventing ring, plural pairs of the self rotation preventing pin and a self rotation preventing ring hole or plural pairs of self rotation preventing pin, the self rotation preventing ring and the self rotation preventing ring hole, that has a larger radius than a theoretical revolving radius of the revolving scroll member so as to include a revolving radius variable by means of the driven crank mechanism and by offsetting the self rotation preventing pin, the self rotation preventing ring or the self rotation preventing ring hole in a direction of reducing a twist of the revolving scroll member to the fixed scroll member in accordance with the maximum displacement R, wherein an orbit correction part is provided in the self rotation preventing ring hole of the revolving scroll member, and wherein the orbit correction part is formed into the shape of a ring hole formed by smoothly connecting the self rotation preventing ring hole having a small arc for reducing the maximum displacement R in a section of prevention of self rotation by means of the self rotation preventing pin and the self rotation preventing ring to the self rotation preventing ring hole having a large arc for increasing the maximum displacement R in a section of no prevention of self rotation by means of the self rotation preventing pin and the self rotation preventing ring.

2. The scroll compressor according to claim 1, wherein the self rotation preventing pin is provided in a thrust support member of the revolving scroll member, the self rotation preventing ring hole is provided in the revolving scroll member and the self rotation preventing ring is provided in the self rotation ring hole, respectively.

3. The scroll compressor according to claim 1, wherein the orbit correction part is formed so that a ring thickness recognized as a difference between an outer diameter and an inner diameter of the self rotation preventing ring would be increased in the section of prevention of self rotation.

4. The scroll compressor according to claim 1, wherein the orbit correction part is provided to set an orbit bending angle $\xi$ of the revolving scroll member in changing the self rotation preventing pin and the self rotation preventing ring at $\xi$0.9 deg.

5. The scroll compressor according to claim 1, wherein the self rotation preventing ring hole, the self rotation preventing ring and the self rotation preventing pin are provided in four or more plural places.

6. A scroll compressor, comprising:

a pair of a fixed scroll member and a revolving scroll member, the pair being engaged with each other to form a compression chamber; a driven crank mechanism for driving the revolving scroll member to revolutionary turn around the fixed scroll member; and a pin-and-ring self rotation preventing mechanism for preventing self rotation of the revolving scroll member by setting a maximum displacement R in a direction of self rotation of the revolving scroll member, the maximum displacement R being determined in accordance with contact among plural pairs of a self rotation preventing pin and a self rotation preventing ring, plural pairs of the self rotation preventing pin and a self rotation preventing ring hole or plural pairs of self rotation preventing pin, the self rotation preventing ring and the self rotation preventing ring hole, that has a larger radius than a theoretical revolving radius of the revolving scroll member so as to include a revolving radius variable by means of the driven crank mechanism and by offsetting the self rotation preventing pin, the self rotation preventing ring or the self rotation preventing ring hole in a direction of reducing a twist of the revolving scroll member to the fixed scroll member in accordance with the maximum displacement R, wherein an orbit correction part is provided in the self rotation preventing ring hole of the revolving scroll member, wherein the orbit correction part is formed into the shape of a ring hole formed by extending a small arc for reducing the maximum displacement R at least to a theoretical point of a change of the pin and the ring to connect the small arc to the self rotation preventing ring hole having a large arc for increasing the maximum displacement R.

7. A scroll compressor comprising:

a pair of a fixed scroll member and a revolving scroll member, the pair being engaged with each other to form a compression chamber; a driven crank mechanism for driving the revolving scroll member to revolutionary turn around the fixed scroll member; and a pin-and-ring self rotation preventing mechanism for preventing self rotation of the revolving scroll member by setting a maximum displacement R in a direction of self rotation of the revolving scroll member, the maximum displacement R being determined in accordance with contact among plural pairs of a self rotation preventing pin and a self rotation preventing ring, plural pairs of the self rotation preventing pin and a self rotation preventing ring hole or plural pairs of self rotation preventing pin, the self rotation preventing ring and the self rotation preventing ring hole, that has a larger radius than a theoretical revolving radius of the revolving scroll member so as to include a revolving radius variable by means of the driven crank mechanism and by offsetting the self rotation preventing pin, the self rotation preventing ring or the self rotation preventing ring hole in a direction of reducing a twist of the revolving scroll member to the fixed scroll member in accordance with the maximum displacement R, wherein an orbit correction part is provided in a pin outer circumference of the self rotation preventing pin, and wherein the orbit correction part is formed so that the pin outer circumference of the self rotation preventing pin would be formed into the shape of a pin outer circumference formed by smoothly connecting a large arc for reducing the maximum displacement R to a small arc for increasing the maximum displacement R.

* * * * *